US006755501B2

(12) United States Patent
Perkins et al.

(10) Patent No.: US 6,755,501 B2
(45) **Date of Patent: *Jun. 29, 2004**

(54) ALTERNATIVE INK/CLEANER CARTRIDGE

(75) Inventors: Mark D. Perkins, Wayland, NY (US); Kenneth D. Corby, Rochester, NY (US); Diana C. Petranek, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 15 days.

This patent is subject to a terminal disclaimer.

(21) Appl. No.: 10/214,832

(22) Filed: Aug. 8, 2002

(65) Prior Publication Data

US 2004/0027407 A1 Feb. 12, 2004

(51) Int. Cl.[7] ..... B41J 2/165
(52) U.S. Cl. ..... 347/22; 347/85
(58) Field of Search ..... 347/49, 22, 85–87

(56) References Cited

U.S. PATENT DOCUMENTS

| | | | |
|---|---|---|---|
| 4,183,031 | A | 1/1980 | Kyser et al. |
| 4,506,276 | A | 3/1985 | Kyser et al. |
| 4,853,708 | A | 8/1989 | Walters |
| 4,907,019 | A | 3/1990 | Stephens |
| 4,961,088 | A | 10/1990 | Gilliland et al. |
| 5,138,344 | A | 8/1992 | Ujita |
| D341,157 | S | 11/1993 | Kitahara et al. |
| 5,266,968 | A | 11/1993 | Stephenson |
| 5,293,913 | A | 3/1994 | Preszler |
| 5,406,320 | A | 4/1995 | Durst et al. |
| 5,408,746 | A | 4/1995 | Thoman et al. |
| 5,410,641 | A | 4/1995 | Wakabayashi et al. |
| 5,506,611 | A | 4/1996 | Ujita et al. |
| 5,519,422 | A | 5/1996 | Thoman et al. |
| 5,530,531 | A | 6/1996 | Girard |
| 5,552,816 | A | 9/1996 | Oda et al. |
| 5,561,450 | A | 10/1996 | Brewster, Jr. et al. |
| 5,610,635 | A | 3/1997 | Murray et al. |
| 5,666,146 | A | 9/1997 | Mochizuki et al. |
| 5,691,753 | A | 11/1997 | Hilton |
| 5,710,579 | A | 1/1998 | Hahs et al. |
| 5,721,576 | A | 2/1998 | Barinaga |
| 5,745,137 | A | 4/1998 | Scheffelin et al. |
| 5,751,322 | A | 5/1998 | Miller et al. |
| 5,788,388 | A | 8/1998 | Cowger et al. |
| 5,825,387 | A | 10/1998 | Cowger et al. |
| 5,825,388 | A | 10/1998 | Sasaki |
| 5,835,817 | A | 11/1998 | Bullock et al. |
| 5,860,363 | A | 1/1999 | Childers et al. |
| 5,880,764 | A | 3/1999 | Barinaga |
| 5,920,333 | A | 7/1999 | Bates |
| 5,956,057 | A | 9/1999 | Childers et al. |
| 5,959,647 | A | 9/1999 | Claramunt et al. |
| 6,000,773 | A | 12/1999 | Murray et al. |
| 6,003,985 | A | 12/1999 | Bekki |
| 6,019,449 | A | 2/2000 | Bullock et al. |

(List continued on next page.)

FOREIGN PATENT DOCUMENTS

| | | |
|---|---|---|
| DE | 3405164 A1 | 8/1985 |
| JP | 359-214656 | 12/1984 |
| JP | 363-004953 | 1/1988 |

*Primary Examiner*—Shih-Wen Hsieh
(74) *Attorney, Agent, or Firm*—Roger A. Fields

(57) ABSTRACT

An alternative ink/cleaner cartridge includes an egress snout from which an ink supply or a cleaner supply is discharged from the cartridge. The snout and a collar that mates with the snout are mutually configured to permit the collar to mate with the snout only when the collar is in any one of a number of allowable orientations, to provide an identification of an ink supply to be discharged from the cartridge. Alternatively, the snout mates with a cap in place of the collar to prevent a cleaner supply from being discharged from the cartridge.

12 Claims, 9 Drawing Sheets

U.S. PATENT DOCUMENTS 6,059,403 A 5/2000 Burgin
6,065,826 A 5/2000 Robinson et al.
6,102,533 A 8/2000 Nozawa et al.
6,130,695 A 10/2000 Childers et al.
6,151,039 A 11/2000 Hmelar et al.
6,155,678 A 12/2000 Komplin et al.
6,164,743 A 12/2000 Hmelar et al.
6,168,262 B1 1/2001 Clark et al.
6,183,077 B1 2/2001 Hmelar et al.
6,199,973 B1 3/2001 Bartolome et al.
6,199,977 B1 3/2001 Komplin et al.
6,203,147 B1 3/2001 Battey et al.
6,209,996 B1 4/2001 Gasvoda et al.
6,227,638 B1 5/2001 Childers et al.
6,227,643 B1 5/2001 Purcell et al.
6,227,663 B1 5/2001 Santhanam et al.
6,243,116 B1 6/2001 Kotaki et al.
6,554,402 B2 * 4/2003 Trafton et al. ..... 347/49

* cited by examiner

ALTERNATIVE INK/CLEANER CARTRIDGE

CROSS REFERENCE TO RELATED APPLICATIONS

Reference is made to commonly assigned, copending application Ser. No. 09/931,523, entitled INK CARTRIDGE WITH COLOR DISCRIMINATION STRUCTURE and filed Aug. 16, 2001 in the names of Trafton, Newkirk, and Robinson; Ser. No. 09/931,420, entitled INK CARTRIDGE WITH ALIGNMENT FEATURES AND METHOD OF INSERTING CARTRIDGE INTO A PRINTER RECEPTACLE and filed Aug. 16, 2001 in the names of Trafton, Newkirk, Robinson, and Gotham; Ser. No. 09/931,521, entitled INK CARTRIDGE WITH MEMORY CHIP AND METHOD OF ASSEMBLING and filed Aug. 16, 2001 in the names of Trafton, Newkirk, and Robinson; and Ser. No. 09/931,313, entitled INK CARTRIDGE WITH INTERNAL INK BAG AND METHOD OF FILLING and filed Aug. 16, 2001 in the names of Trafton, Farnung, and Petranek.

Reference is also made to commonly assigned, copending applications Ser. No. 10/198,512, entitled INK CARTRIDGE HAVING INK IDENTIFIER ORIENTED TO PROVIDE INK IDENTIFICATION and filed Jul. 18, 2002 in the names of Perkins and Corby, and Ser. No. 10/198,516, entitled DISPOSABLE INK ASSEMBLAGE and filed Jul. 18, 2002 in the names of Perkins and Corby.

All of the cross-referenced applications are incorporated into this application.

FIELD OF THE INVENTION

The invention relates generally to cartridges for ink jet printers, and in particular to an ink cartridge that alternatively can be a cleaner cartridge.

BACKGROUND OF THE INVENTION

The cross-referenced applications filed Aug. 16, 2001, particularly Ser. No. 09/931,523 entitled INK CARTRIDGE WITH COLOR DISCRIMINATION STRUCTURE, disclose an ink cartridge that has a means for visibly identifying the ink supply in the cartridge such as by color or type.

The disclosed ink cartridge includes an ink bag containing an ink supply, an ink egress snout attached to the ink bag and from which the ink supply is discharged from the ink bag, and a split collar that receives or mates with the snout via an annular rib on the collar and an annular groove on the snout. The collar when mated with the snout can be rotated about the snout to any one of a number of allowable orientations. The particular orientation of the collar that is selected serves to identify the ink supply in the ink bag.

A pair of housing halves for the ink bag when connected together form a bottom opening for the collar. The bottom opening is bounded by multisided edges of the housing halves. The collar has a peripheral recess with a multisided floor that complements the multi-sided edges. This permits the collar when arranged in any one of the orientations to be trapped in the bottom opening to prevent rotation of the collar relative to the snout. Moreover, it serves to secure the bag to the housing halves.

SUMMARY OF THE INVENTION

According to one aspect of the invention, an alternative ink/cleaner cartridge comprising an egress snout from which an ink supply or a cleaner supply is discharged from the cartridge, is characterized in that:

the snout and a collar that mates with the snout are mutually configured to permit the collar to mate with the snout only when the collar is in any one of a number of allowable orientations, to provide an identification of an ink supply to be discharged from the cartridge; and the snout mates with a cap in place of the collar to prevent a cleaner supply from being discharged from the cartridge.

According to another aspect of the invention, an alternative method of partially assembling a cartridge including an egress snout from which an ink supply or a cleaner supply is discharged from the cartridge, said method comprising:

mating the snout with a collar that is mutually configured with the snout to permit the snout to mate with the collar only when the collar is in any one of a number of allowable orientations, to provide an identification of an ink supply to be discharged from the cartridge; or mating the snout with a cap in place of the collar to prevent a cleaner supply from being discharged from the cartridge.

DETAILED DESCRIPTION OF THE INVENTION

Figure 1:
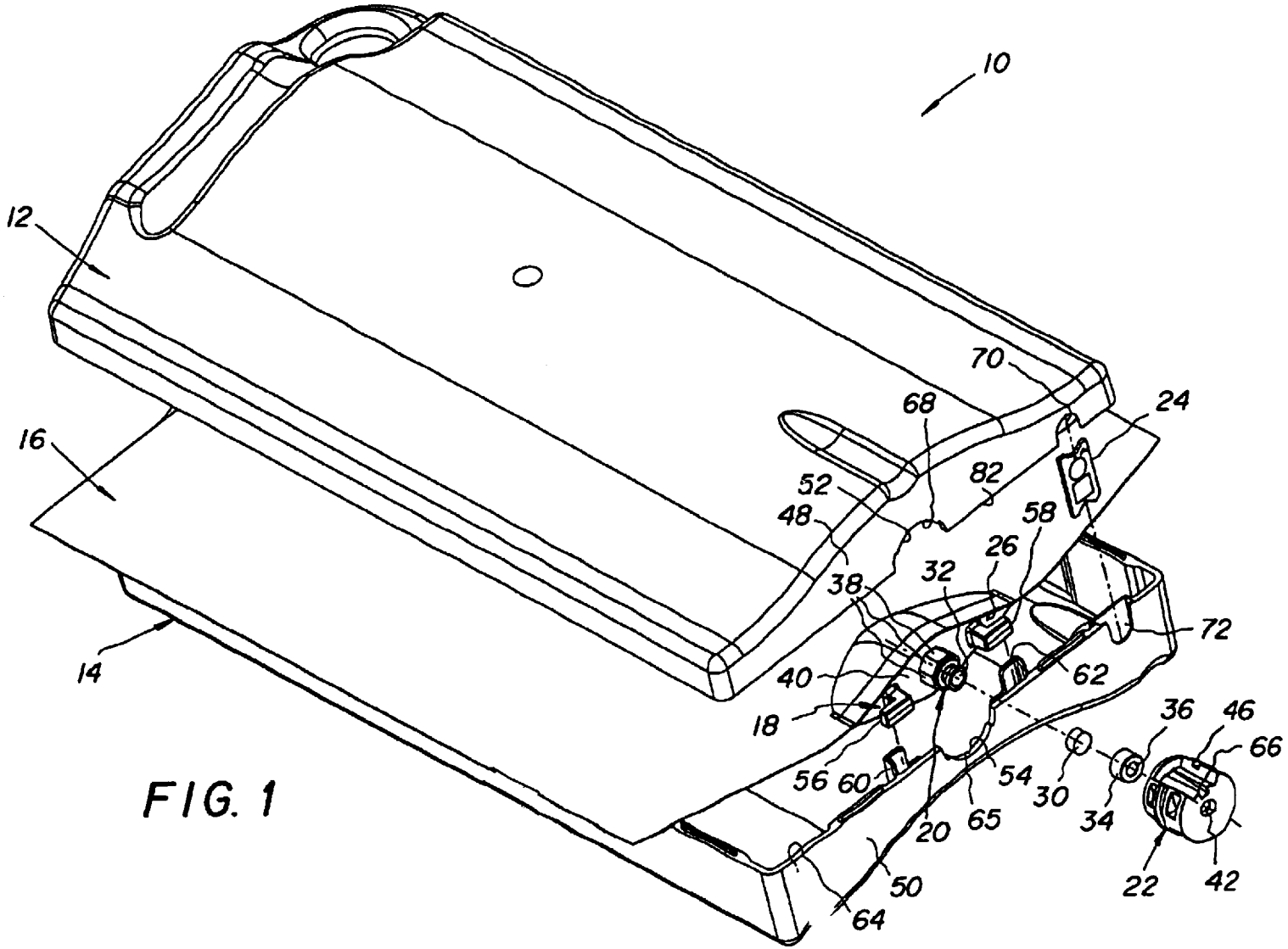
FIG. 1 is an exploded perspective view of an alternative ink/cleaner cartridge including an egress snout from which an ink supply or a cleaner supply is discharged from the cartridge, and a collar that mates with the snout in any one of a number of allowable orientations to provide an identification of the ink supply to be discharged from the cartridge, according to a preferred embodiment of the invention.

Referring now to the drawings, FIGS. 1–12 show an alternative ink/cleaner cartridge 10 for an ink jet printer (not shown).

The cartridge 10 when used as an ink cartridge includes the following components:

a pair of plastic housing halves 12 and 14 that mate or connect to form a cartridge housing;

a disposable flexible ink supply bag 16;

a plastic connector-fitting or fitment 18 having an integral ink egress snout 20 for discharging an ink supply from the bag 16;

a plastic single-part collar 22 for the snout 20, which functions as an ink identifier to identify the ink supply in the bag 16 such as by color or type; and a memory chip 24.

Figure 3:
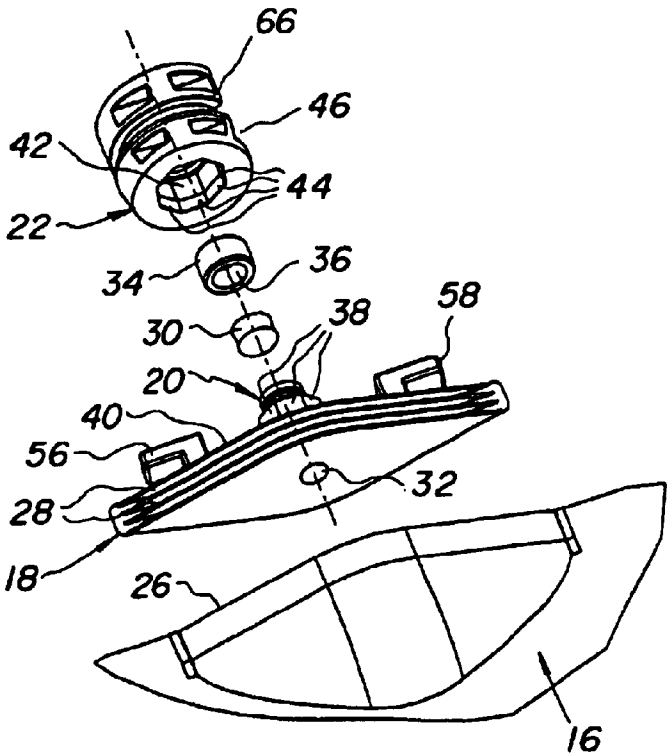
FIGS. 2 and 3 are exploded perspective views of the egress snout and the collar as shown from opposite views.
Figure 2:
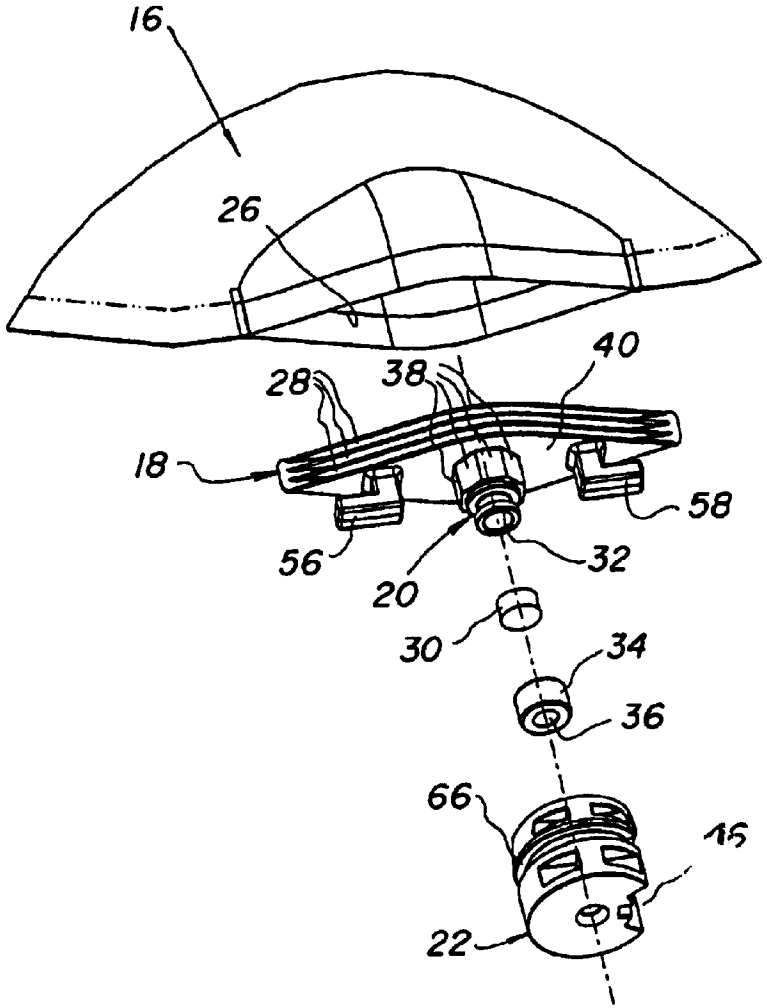

As shown in FIGS. 2 and 3, the fitting 18 is attached via a thermal seal to the bag 16, within an elongate opening 26 in the bag. During the thermal seal of the bag 16 to the fitting 18, a small amount of melted material from the bag flows to between parallel ribs 28 along opposite longitudinal sides of the fitting 18 to provide an essentially leak-proof seal between the bag and the fitting. A rubber septum 30 is tightly inserted into an ink egress opening 32 in the snout 20 to plug the opening. Then, an aluminum or stainless steel cap 34 is press-fitted on the snout 20. The cap 34 partially overlaps the septum 30 to capture the septum, and has a center opening 36 which allows a hollow needle (not shown) to pierce the septum in order to discharge an ink supply from the bag 16 when the cartridge 10 is used in an ink jet printer.

Collar 22 and Snout 20

The snout 20 has eight identical outer peripheral surfaces (sides) or facets 38 that project perpendicular from a longitudinal planar face 40 of the fitting 18 to form an octagon. See FIGS. 2 and 3. In a similar sense, the collar 22 has a center opening 42 that is circumscribed by eight identical inner peripheral surfaces (sides) or facets 44 that form an octagon. This mutual or complementary configuration allows the snout 20 to be received in the center opening 42 only when the collar 22 is in any one of eight allowable angular orientations 0° or 360°, 45°, 90°, 135°, 180°, 225°, 270°, and 315°. Preferably, the eight surfaces 44 of the collar 22 are aligned with the eight surfaces 38 of the snout 20 to position the collar relative to the snout in a selected one of the eight orientations. Then, the collar 22 is mated with the snout 20 in the selected orientation. Respective contact between the eight surfaces 38 and the eight surfaces 44 prevents the collar 22 from being rotated about the snout 22 and thus serves to fix the collar in the selected orientation. The selected orientation provides a visible indication that serves to identify the ink supply in the bag 16 such as by color or type.

As described in the cross-referenced applications filed Aug. 16, 2001 and incorporated into this application, the collar 22 has a key slot or key-way 46 that is angular positioned in accordance with the selected orientation of the collar. The hollow needle (not shown) for piercing the septum 30 in order to discharge an ink supply from the bag 16 when the cartridge 10 is used in an ink jet printer, is mounted on a key assembly (not shown) having a key tab intended to be received in the key slot 46. The particular orientation of the key assembly must match the selected orientation of the collar 22 in order for the key tab to be received in the key slot 46.

The number of the surfaces 38 of the snout 20 and the number of the surfaces 44 of the collar 22, need not each be eight (although they must be the same number). Preferably, the number of the surfaces 38 of the snout 20 and the number of the surfaces 44 of the collar 22 fall within the range 4–12. All that is necessary is that the number of the surfaces 38 of the snout 20 and the number of the surfaces 44 of the collar 22 form similar complementary polygons that permit the collar 22 to mate with the snout 20.

L-Shaped Engageable-Disengageable Members 56, 58, 60, 62

The housing halves 12 and 14 at respective bottom wall portions 48 and 50 have opening halves 52 and 54 that form a single bottom opening when the housing halves are connected together. See FIGS. 1 and 4. The fitting 18 has a pair of L-shaped engageable-disenageable members or tabs 56 and 58 that project from respective areas of the face 40 (of the fitting) which are spaced from the snout 20. In a similar sense, a pair of L-shaped engageable-disengageable members or tabs 60 and 62 project from an inner side 64 of the wall portion 50 and are spaced from the opening half 52. The L-shaped engageable-disengageable members 56 and 58 extend in opposite directions as do the L-shaped engageable-disengageable members 60 and 62. This complementary arrangement or mutual configuration permits the L-shaped member 56 to engage the L-shaped member 60 and the L-shaped member 58 to engage the L-shaped member 62 when the bag 16 is placed on the housing half 14. The bag 16 is thus secured in place. At the same time an edge 65 of the opening half 54 (shown in FIG. 1) is received in an outer peripheral groove 66 in the collar 22 to support the collar. Then, when the housing half 12 is connected to the housing half 14 an edge 68 of the opening half 52 is received in the groove 66.

When the bag 16 is emptied, it is possible to remove the bag (with the fitting 18) from the cartridge 10. If the housing half 12 is disconnected from the housing half 14, the L-shaped engageable-disengageable members 56 and 58 are disengaged from the L-shaped engageable-disengageable members 60 and 62. Also, the collar 22 can be removed from the snout 20.

Other L-shaped engageable-disengageable members can be provided on the fitting 18 and the housing half 14 in addition to the L-shaped engageable-disengageable members 56 and 58 and the L-shaped engageable-disengageable members 60 and 62. Also, it is not necessary that these engageable-disengageable members be L-shaped. A number of known engagements or interlocks can be used instead, such as pins in holes, etc.

Pocket for Memory Chip 24

As shown in FIGS. 1 and 4–6, the housing halves 12 and 14 at bottom wall portions 48 and 50 have respective pocket portions 70 and 72 which include slightly smaller and larger wall opening portions 74 and 76 and sleeve or channel portions 78 and 80. Moreover, the bottom wall portion 48 at an inner side 82 and the bottom wall portion 50 at the inner side 64 have respective ink blocking shield segments 84 and 86 that project inwardly of the housing halves 12 and 14 from the inner sides. See FIGS. 5 and 6. The ink blocking shield segment 84 is an integral extension of the inner side 82 and extends across the wall opening portion 74, and the ink blocking shield segment 86 is an integral extension of the inner side 64 and extends across the wall opening portion 76. This is to isolate or seal the wall opening portions 74 and 76 from the interiors of the housing halves 12 and 14.

When the housing halves 12 and 14 are connected together, the memory chip 24 is peripheral-edge supported in the channel portions 78 and 80 to hold the memory chip in the wall opening portions 74 and 76. Also, the pocket portions 70 and 72 combine to form a single pocket including the wall opening portions 74 and 76 combining to form a single wall opening, and the ink blocking shield segments 84 and 86 abut end-to-end to seal the single wall opening. The ink supply bag 16, which is between the housing halves 12 and 14, might per chance leak ink. However, the ink blocking shield segments 84 and 86 which are then abutted end-to-end prevent any ink from entering the wall opening portions 74 and 76 and contaminating the memory chip 24.

Optional Stakes for Fitting 18

Figure 4:
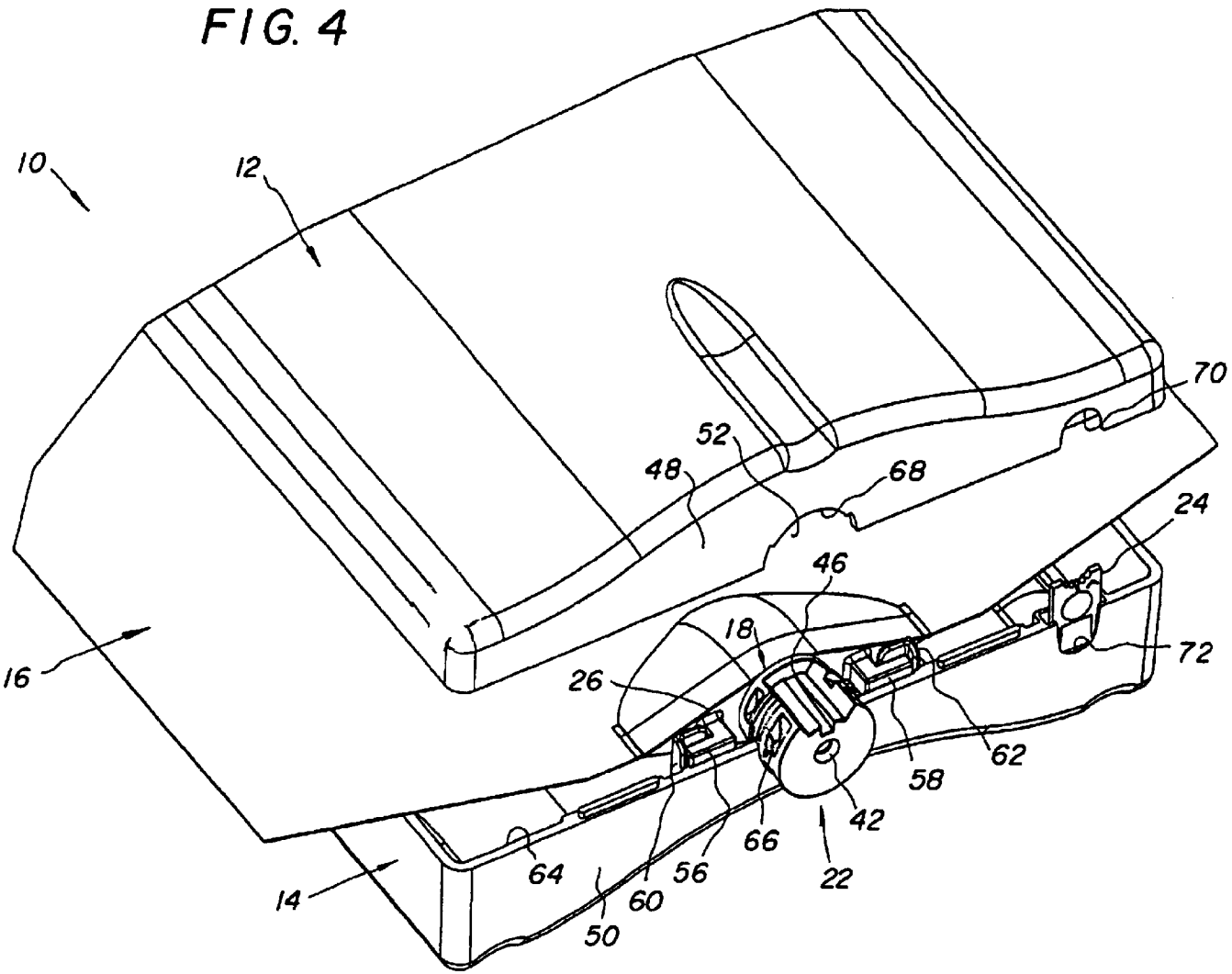
FIG. 4 is an enlargement of a bottom portion of the cartridge as shown in FIG. 1.
Figure 6:
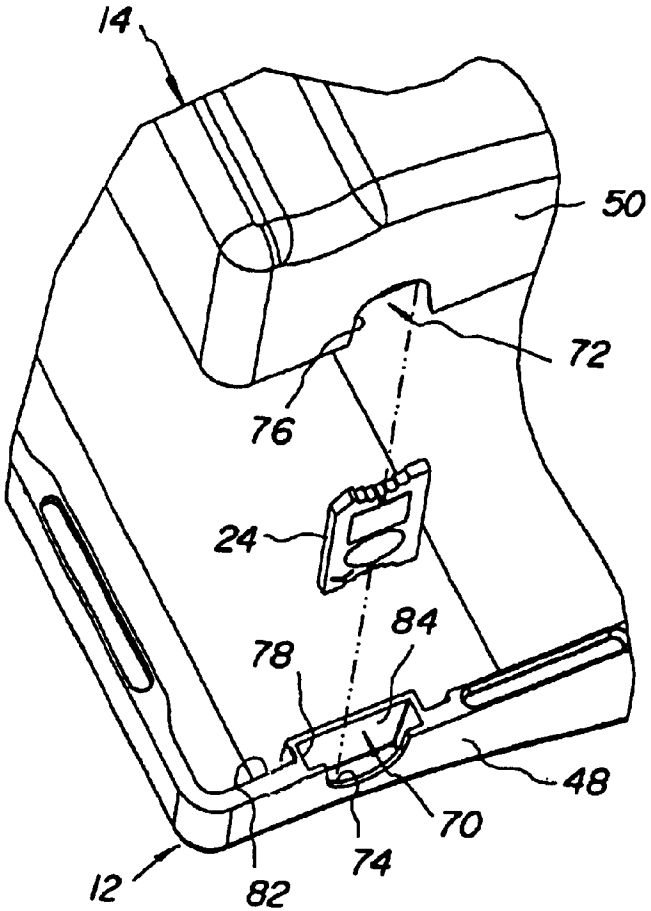
FIGS. 5 and 6 are exploded perspective views of a memory chip shown being inserted into a pocket in a housing of the cartridge.
Figure 5:
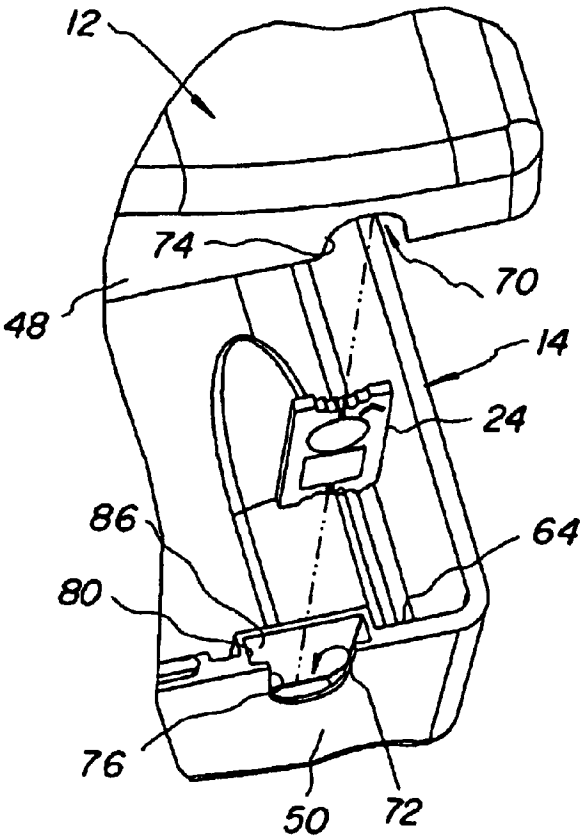
Figure 7:
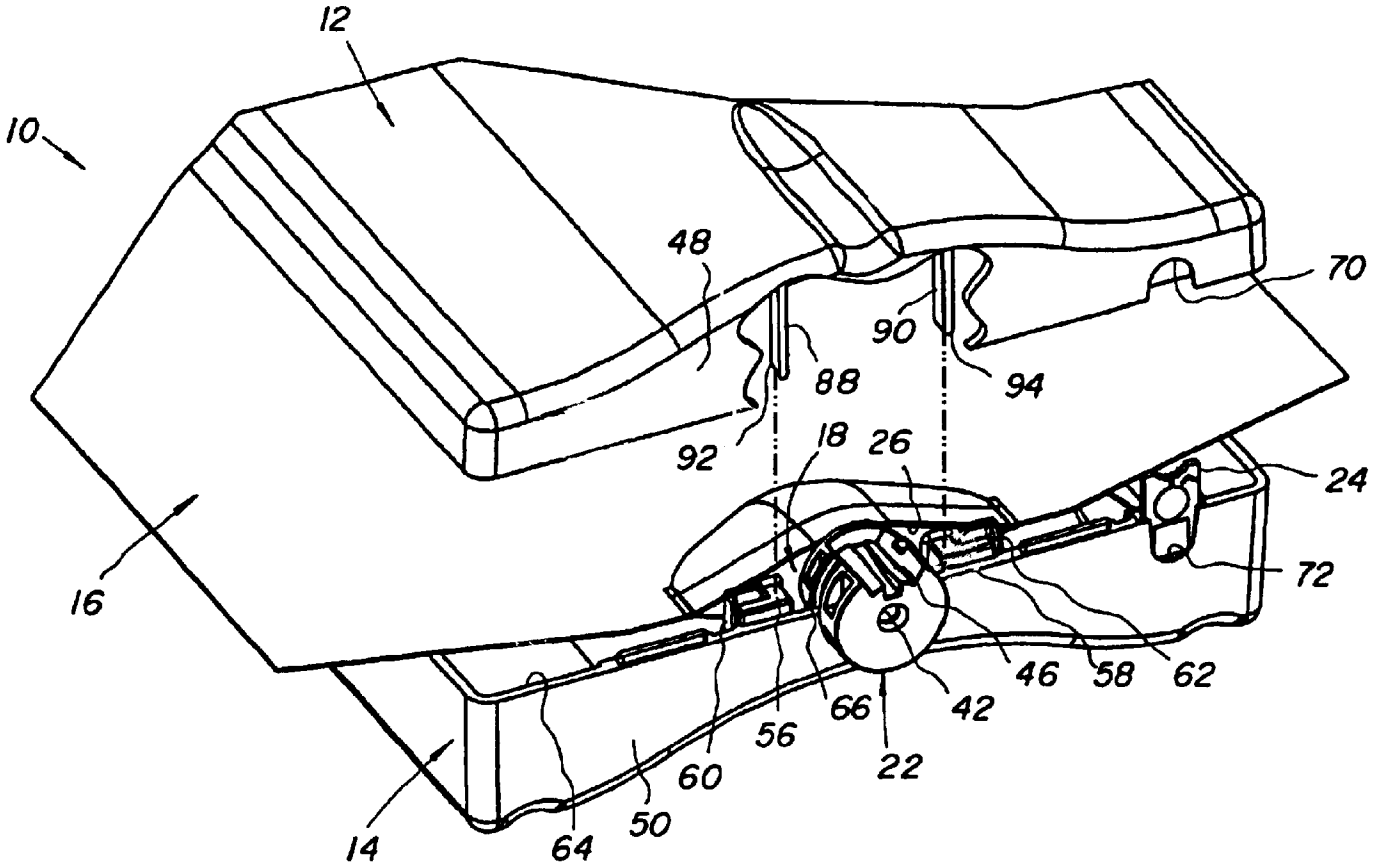
FIG. 7 is a view similar to FIG. 4, showing the housing partially cut away to reveal stakes that are adhered to a fitting for an alternative ink/cleaner bag in the housing.

As shown in FIG. 7, the housing half 12 has at least two interior stakes 88 and 90 that project from the housing half and are parallel to the bottom wall portion 48 of the housing half. When the housing halves 12 and 14 connected together, respective tips 92 and 94 of the stakes 88 and 90 are melted preferably onto the L-shaped engageable-disengageable members 56 and 58 of the fitting 18 to adhere the stakes to those L-shaped members. The stakes 88 and 90 thus hold the L-shaped engageable-disengageable members 56 and 58 of the fitting 18 fast to the housing half 12, and can be separated from those L-shaped members only by breaking the connection at the melted tips 92 and 94 (or by breaking the stakes and/or the L-shaped members). This positively ensures that the fitting 18 cannot shift, however slightly, when the L-shaped engageable-disengageable member 56 is engaged with the L-shaped engageable-disengageable member 60 and the L-shaped engageable-disengageable member 58 is engaged with the L-shaped engageable-disengageable member 62 as shown in FIGS. 4 and 7. Also, the fitting 18 cannot be removed from the housing half 12 without forcibly separating the stakes 88 and 90 from the L-shaped engageable-disengageable members 56 and 58.

Alternatively, the tips 92 and 94 of the stakes 88 and 90 can be melted onto the L-shaped engageable members 60 and 62 of the housing half 14 to hold those L-shaped members fast to the housing half 12.

Alternatively, the tips 92 and 94 of the stakes 88 and 90 can be melted onto both the L-shaped engageable members 56 and 58 of the fitting 18 and the L-shaped engageable members 60 and 62 of the housing half 14.

The tips 92 and 94 of the stakes 88 and 90 can be melted onto the L-shaped engageable members 56 and 58 of the fitting 18 and/or the L-shaped engageable members 60 and 62 of the housing half 14 via a conventional vibration weld that melts the tips.

Cap 96

FIGS. 8–12 show the cartridge 10 when used as a cleaner cartridge instead of an ink cartridge. In this instance, the bag 16 is a cleaner supply bag instead of an ink supply bag, and a cap 96 is mated with the snout 20 in place of the collar 22. The cap 96 must be removed from the snout 20 to allow a hollow needle (not shown) to pierce the septum 30 in order to discharge a cleaner material, e.g. a known cleaner solution, from the bag 16. The cleaner material is intended to be applied in an ink jet printer instead of an ink supply, to clean the ink jet printer of any ink residue.

The cap 96 has the same diameter as the collar 22 and, like the center opening 42 in the collar, it has a center opening 98 for receiving the snout 20. See FIGS. 3 and 10. Also, like the outer peripheral groove 66 in the collar 22, the cap 96 has an outer peripheral groove 100 for receiving the edge 65 of the opening half 54 in the bottom wall portion 50 of the housing half 14 and for receiving the edge 68 of the opening half 52 in the bottom wall portion 48 of the housing half 12. See FIGS. 1, 4 and 8, 11.

Figure 8:
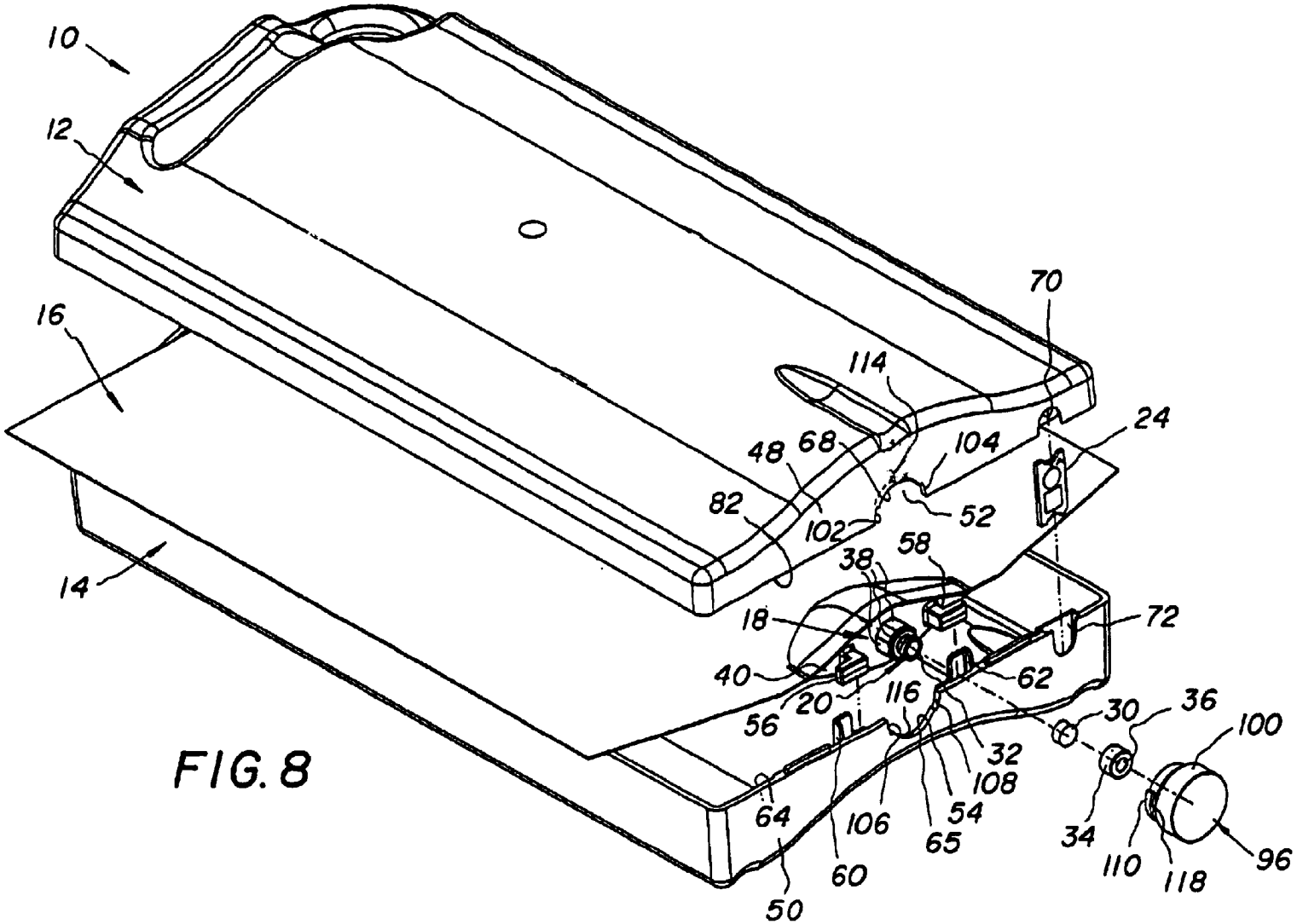
FIG. 8 is similar to FIG. 1, except that a cap is mated with the snout in place of the collar to prevent a cleaner supply from being discharged from the cartridge, according to the preferred embodiment of the invention.
Figure 10:
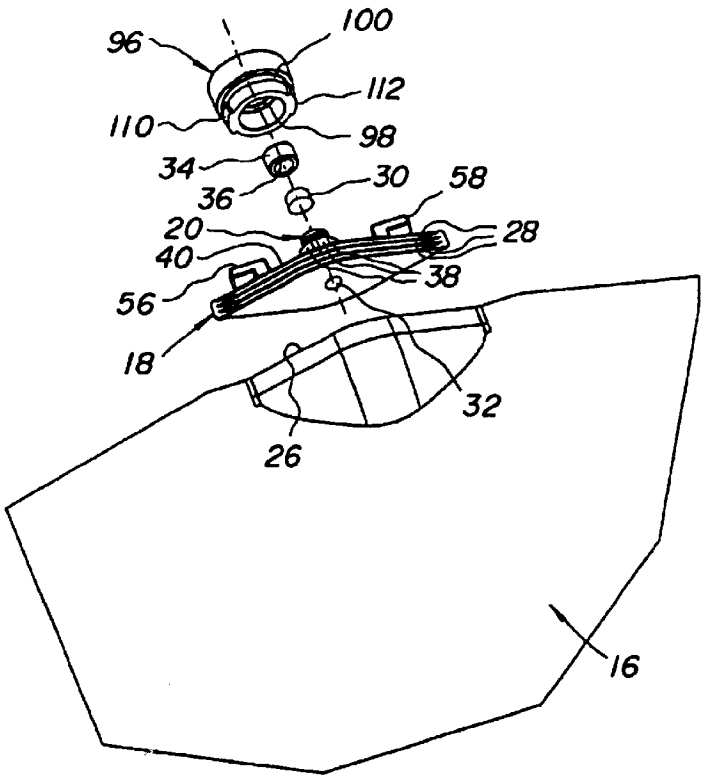
FIGS. 9, 10 and 11 are similar to FIGS. 2, 3 and 4, except that the cap is shown rather than the collar.
Figure 9:
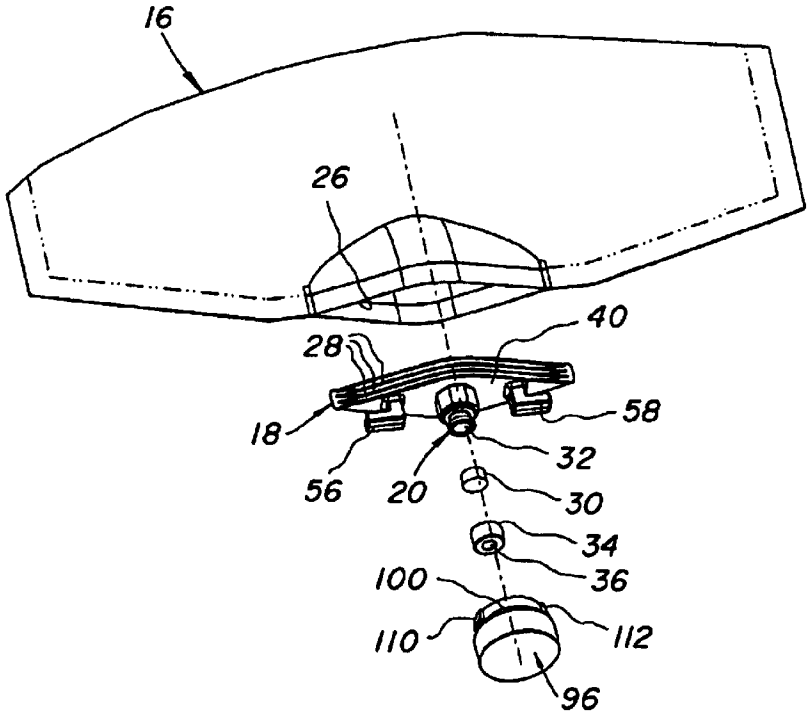
Figure 11:
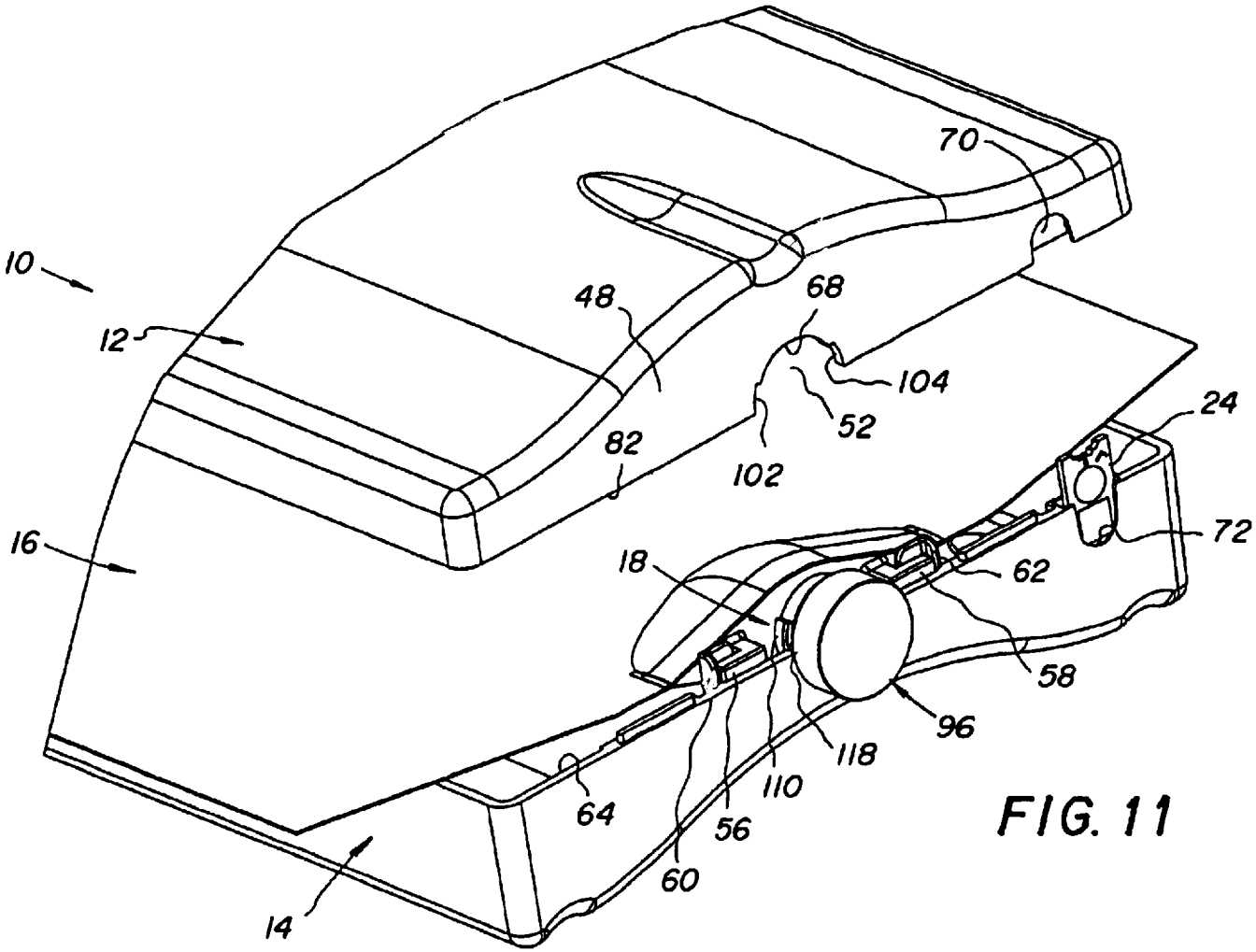

As shown in FIG. 8, the bottom wall portion 48 of the housing half 12 has a pair of clearance recesses 102 and 104 at the edge 68 of the opening half 52, and the bottom wall portion 50 of the housing half 14 has a pair of clearance recesses 106 and 108 at the edge 65 of the opening half 54. The four clearance recesses 102, 104, 106 and 108 permit a pair of lugs 110 and 112 on the cap 96 to be admitted through the opening halves 52 and 54. Then, when the cap 96 is rotated on the snout 20, the lugs 110 and 112 engage with the bottom wall portions 48 and 50 at their inner sides 82 and 64.

Figure 12:
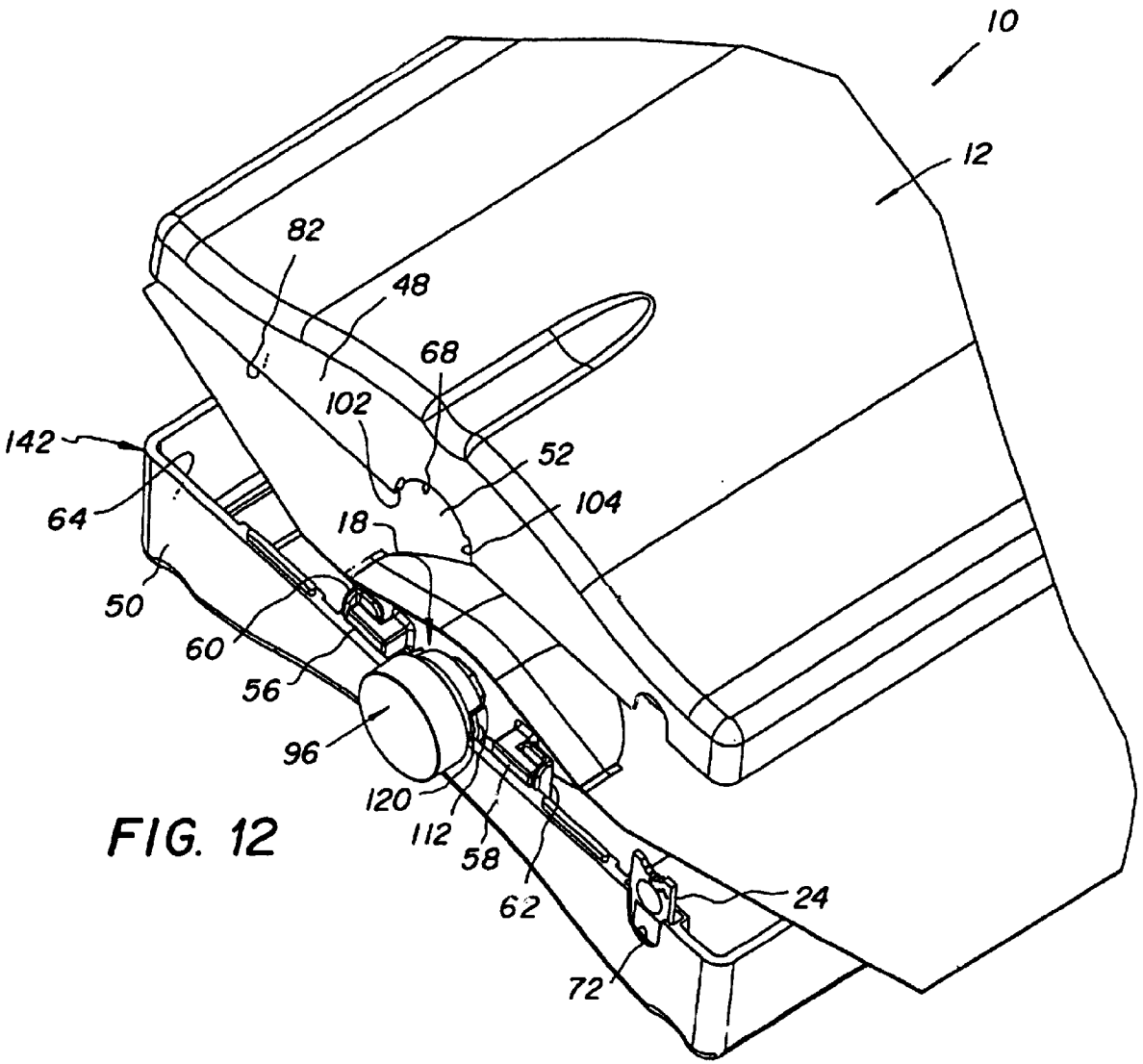
FIG. 12 is similar to FIG. 11, but as shown from an opposite view.

As shown in FIGS. 8 and 12, the inner side 82 of the bottom wall portion 48 has a cavity 114 adjacent the edge 68 of the opening half 52, and the inner side 64 of the bottom wall portion 50 has a cavity 116 adjacent the edge 65 of the opening half 54. The cavities 114 and 116 receive respective protuberances or bumps 118 and 120 adjacent the lugs 110 and 112 on the cap 96 when the cap is rotated on the snout 20 (with the lugs against the inner sides 82 and 64 of the bottom wall portions 48 and 50). The protuberances 118 and 120 in combination with the cavities 114 and 116 serve to prevent unintended rotation of the cap 96.

The invention has been described in detail with particular reference to certain preferred embodiments thereof, but it will be understood that variations and modifications can be effected within the spirit and scope of the invention.

Parts List

10. ink cartridge
12. housing half
14. housing half
16. ink bag
18. connector-fitting
20. snout
22. collar
24. memory chip
26. elongate opening
28. ribs
30. septum
32. ink egress opening
34. cap
36. center opening
38. eight surfaces or facets
40. face
42. center opening
44. eight surfaces or facets
46. key slot
48. bottom wall portion
50. bottom wall portion
52. opening half
54. opening half
56. L-shaped engageable member
58. L-shaped engageable member
60. L-shaped engageable member
62. L-shaped engageable member
64. inner side
65. edge
66. groove
68. edge
70. pocket portion
72. pocket portion
74. wall opening portion
76. wall opening portion
78. sleeve or channel portion
80. sleeve or channel portion
82. inner side
84. ink blocking shield segment
86. ink blocking shield segment
88. stake
90. stake
92. tip
94. tip
96. cap
98. center opening
100. groove
102. clearance recess
104. clearance recess
106. clearance recess
108. clearance recess
110. lug

112. lug
114. cavity
116. cavity
118. protuberance
120. protuberance

What is claimed is:

1. An alternative ink/cleaner cartridge comprising an egress snout from which an ink supply or a cleaner supply is discharged from said cartridge, is characterized in that:

said snout and a collar that mates with said snout are mutually configured to permit said collar to mate with said snout only when said collar is in any one of a number of allowable orientations, to provide an identification of an ink supply to be discharged from said cartridge; and said snout mates with a cap in place of said collar to prevent a cleaner supply from being discharged from said cartridge.

2. An alternative ink/cleaner cartridge as recited in claim 1, wherein a housing has a bottom opening that is bounded by an edge, said collar has a groove that receives said edge when said collar mates with said snout, and said cap has a groove that receives said edge when said snout mates with said cap in place of said collar.

3. An alternative ink/cleaner cartridge as recited in claim 2, wherein said cap has lugs that engage with said housing to hold said cap on said snout.

4. An alternative ink/cleaner cartridge as recited in claim 3, wherein said cap is rotatable on said snout, and said housing has respective clearance recesses at said edge that permit said lugs to enter said housing through said bottom opening in order to engage with said housing when said cap is rotated on said snout.

5. An alternative ink/cleaner cartridge as recited in claim 4, wherein said housing has cavities adjacent said edge, and said cap has respective protuberances adjacent said lugs which are received in said cavities when said lugs are engaged with said housing.

6. An alternative ink/cleaner cartridge as recited in claim 1, wherein said collar and said cap each have a similar diameter.

7. An alternative ink/cleaner cartridge as recited in claim 6, wherein said collar and said cap each have a center opening for receiving said snout.

8. An alternative ink/cleaner cartridge as recited in claim 1, wherein said snout and said collar have an equal number of mutually contacting surfaces that are the same number as the number of allowable orientations in order to fix said collar with respect to with said snout in a selected one of the orientations when said collar mates with said snout.

9. An alternative ink/cleaner cartridge as recited in claim 8, wherein said mutually contacting surfaces of said snout and said collar define respective complementary polygons.

10. An alternative ink/cleaner cartridge as recited in claim 1, wherein said snout is connected to a bag alternatively for an ink supply and a cleaner supply.

11. An alternative method of partially assembling a cartridge including an egress snout from which an ink supply or a cleaner supply is discharged from the cartridge, said method comprising:

mating the snout with a collar that is mutually configured with the snout to permit the snout to mate with the collar only when the collar is in any one of a number of allowable orientations, to provide an identification of an ink supply to be discharged from the cartridge; or mating the snout with a cap in place of the collar to prevent a cleaner supply from being discharged from the cartridge.

12. An alternative method as recited in claim 11, further comprising:

engaging the cap with a housing to hold the cap on the snout when the snout is mated with the cap.

* * * * *